US005778676A

United States Patent [19]

Joshi et al.

[11] Patent Number: 5,778,676

[45] Date of Patent: Jul. 14, 1998

[54] DUAL FUEL MIXER FOR GAS TURBINE COMBUSTOR

[75] Inventors: Narendra D. Joshi, Cincinnati; Paul R. Angel, Fairfield, both of Ohio; James M. Caldwell; Paul V. Heberling, both of Alexandria, Ky.; Anthony J. Dean, Scotia, N.Y.

[73] Assignee: General Electric Company, Cincinnati, Ohio

[21] Appl. No.: 581,817

[22] Filed: Jan. 2, 1996

[51] Int. Cl.[6] ..... F02C 1/00; F02G 3/00

[52] U.S. Cl. ..... 60/746; 60/39.463; 60/737; 60/742; 60/746; 60/748; 60/755; 239/405; 239/424.5; 239/543

[58] Field of Search ..... 60/39.463, 737, 60/740, 742, 739, 746, 748, 755, 756; 239/405, 416.4, 416.5, 424, 424.5, 425, 428, 543

[56] References Cited

U.S. PATENT DOCUMENTS

| | | | |
|---|---|---|---|
| 4,695,247 | 9/1987 | Enzaki et al. | 60/755 |
| 5,165,241 | 11/1992 | Joshi et al. | 60/737 |
| 5,233,828 | 8/1993 | Napoli | 60/755 |
| 5,251,447 | 10/1993 | Joshi et al. | 60/737 |
| 5,351,477 | 10/1994 | Joshi et al. | 60/737 |

OTHER PUBLICATIONS

U.S. Patent application Ser. No. 08/545,438, filed Oct. 1995, entitled Low Emissions Combustor Premixer, by Anthony J. Dean.

*Primary Examiner*—Charles G. Freay
*Attorney, Agent, or Firm*—Andrew C. Hess; Wayne O. Traynham

[57] ABSTRACT

An air fuel mixer is disclosed having a mixing duct, a shroud surrounding the upstream end of the mixing duct in which a fuel manifold is provided in flow communication with a fuel supply and control means, a set of inner and outer counter-rotating swirlers adjacent the upstream end of the mixing duct for imparting swirl to an air stream, a hub separating the inner and outer annular swirlers to allow independent rotation of the air stream, and a centerbody located axially along and substantially the full length of the mixing duct. In order to inject one type of fuel into the mixing duct, fuel is supplied to the outer annular swirlers which include hollow vanes with internal cavities, wherein the internal cavities of the outer swirler vanes are in fluid communication with the fuel manifold in the shroud. The outer swirler vanes further include a plurality of fuel passages therethrough in flow communication with the internal cavities. A second fuel can be injected into the mixing duct by means of a plurality of orifices in the centerbody wall which are in flow communication with a fuel supply and control means. In this way, high pressure air from a compressor is injected into the mixing duct through the swirlers to form an intense shear region and fuel is injected into the mixing duct from the outer swirler vane passages and/or the centerbody orifices so that the high pressure air and the fuel is uniformly mixed therein so as to produce minimal formation of poullutants when a fuel/air mixture is exhausted out the downstream end of the mixing duct into the combustor and ignited.

32 Claims, 7 Drawing Sheets

DUAL FUEL MIXER FOR GAS TURBINE COMBUSTOR

BACKGROUND OF THE INVENTION

1. Field of the Invention

The present invention relates to an air fuel mixer for the combustor of a gas turbine engine and, more particularly, to a dual fuel mixer for the combustor of a gas turbine engine which uniformly mixes liquid and/or gaseous fuel with air so as to reduce NOx formed by the ignition of the air/fuel mixture.

2. Description of Related Art

The present invention involves an air/fuel mixer for a gas turbine combustor which provides gaseous and/or liquid fuel to the mixing duct so as to be mixed with air to form a uniform air/fuel mixture. Other dual fuel air mixers in the art include U.S. Pat. No. 5,351,477 to Joshi et al. and Ser. No. 08/304,341 to Joshi et al., both of which were previously filed by the assignee of the present invention. Each of these prior art air/fuel mixers, as well as the mixer of the present invention, includes a mixing duct, a set of inner and outer counter-rotating swirlers adjacent to the upstream end of the mixing duct, and a hub separating the inner and outer swirlers to allow independent rotation of the air flow therethrough.

However, it will be seen that U.S. Pat. No. 5,351,477 discloses an air/fuel mixer in which gas fuel is injected into the mixing duct by means of passages within the swirler vanes, which are in flow communication with a gas fuel manifold, and liquid fuel is injected into the mixing duct by means of a circumferential slot within the hub separating the inner and outer annular swirlers which is in flow communication with a liquid fuel manifold. Ser. No. 08/304,341 discloses an air/fuel mixer in which gas fuel also is injected into the mixing duct by means of swirler vane passages in flow communication with a gas fuel manifold and liquid fuel is injected into the mixing duct by means of separate tubes and passages within the gas fuel passages which are in flow communication with a liquid fuel manifold. In both instances, high pressure air from a compressor is injected into the mixing duct from the swirlers to form an intense shear region and fuel is injected into the mixing duct so that the high pressure air and the fuel is uniformly mixed therein so as to produce minimal formation of pollutants when the fuel/air mixture is exhausted out the downstream end of the mixing duct into the combustor and ignited.

While the aforementioned dual fuel air/fuel mixers have increased mixing of fuel and air, and correspondingly reduced emissions produced from the burning thereof, additional flexibility in the manner of introducing fuel to the mixing duct has been found to be desirable. In particular, by providing one type of fuel through orifices in a centerbody located within the mixing duct, a greater separation of the fuel injection points for each type of fuel exists. This also allows greater flexibility in the orientation of the fuel injected (e.g., perpendicular to the air stream in the mixing duct instead of parallel thereto) and greater opportunity for fuel atomization, which is particularly important with respect to the injection of liquid fuel. Further, the manufacture and assembly of a mixer having one type of fuel injected through the centerbody is simpler and less costly when compared to the aforementioned mixers.

Moreover, it has been found that even greater mixing can be achieved by injecting the fuel (especially liquid fuel) into the mixing duct in such a way that greater atomization of the fuel occurs, as well as maximum interaction with the swirling air in the mixing duct. Another concern of the present invention is to further minimize the possibility of flashback in the air/fuel mixer caused by boundary layers existing along the surfaces of the mixing duct and centerbody.

SUMMARY OF THE INVENTION

In accordance with one aspect of the present invention, an air fuel mixer is disclosed having a mixing duct, a shroud surrounding the upstream end of the mixing duct in which a fuel manifold is provided in flow communication with a fuel supply and control means, a set of inner and outer counter-rotating swirlers adjacent to the upstream end of the mixing duct for imparting swirl to an air stream, a hub separating the inner and outer annular swirlers to allow independent rotation of the air stream, and a centerbody located axially along and substantially the full length of the mixing duct. In order to inject one type of fuel into the mixing duct, fuel is supplied to the outer annular swirlers which include hollow vanes with internal cavities, wherein the internal cavities of the outer swirler vanes are in fluid communication with the fuel manifold in the shroud. The outer swirler vanes further include a plurality of fuel passages therethrough in flow communication with the internal cavities exhausting into the mixing duct. A second fuel can be injected into the mixing duct by means of a plurality of passages in the centerbody wall which are in flow communication with a fuel supply and control means. In this way, high pressure air from a compressor is injected into the mixing duct through the swirlers to form an intense shear region and fuel is injected into the mixing duct from the outer swirler vane passages and/or the centerbody orifices so that the high pressure air and the fuel is uniformly mixed therein so as to produce minimal formation of pollutants when a fuel/air mixture is exhausted out the downstream end of the mixing duct into the combustor and ignited.

In accordance with a second aspect of the present invention, a plurality of air passages are provided in the mixing duct wall, wherein air flowing through such air passages energizes a boundary layer along an inner annular surface of the mixing duct wall.

In accordance with a third aspect of the present invention, the centerbody includes a hollow area from an upstream end adjacent the swirlers to a downstream end, a main air passage in flow communication with the hollow area, and a plurality of air passages in the centerbody wall in flow communication with the hollow area. In this manner, air supplied to the hollow area by means of the main air passage flows through the air passages in the centerbody wall to energize a boundary layer along an outer annular surface of the centerbody.

In accordance with a fourth aspect of the present invention, the centerbody orifices used for injecting fuel into the mixing duct are oriented with respect to each other such that fuel jets injected into the mixing duct therefrom impinge on each other to enhance atomization of such fuel.

In accordance with a fifth aspect of the present invention, the centerbody also includes a main air passage in flow communication with an air supply and at least one air passage located adjacent each of the fuel orifices in a plurality of radial spokes so that the air passages around the radial spokes are in flow communication with the main air passage, wherein air flowing through the air passages around the radial spokes directs fuel away from an outer annular surface of the centerbody and assists atomization of such fuel in the mixing duct.

In accordance with a sixth aspect of the present invention, liquid fuel passages in the hub separating the inner and outer swirlers have orifices which are oriented with respect to each other such that fuel jets injected into the mixing duct therefrom impinge on each other to enhance atomization of such fuel.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
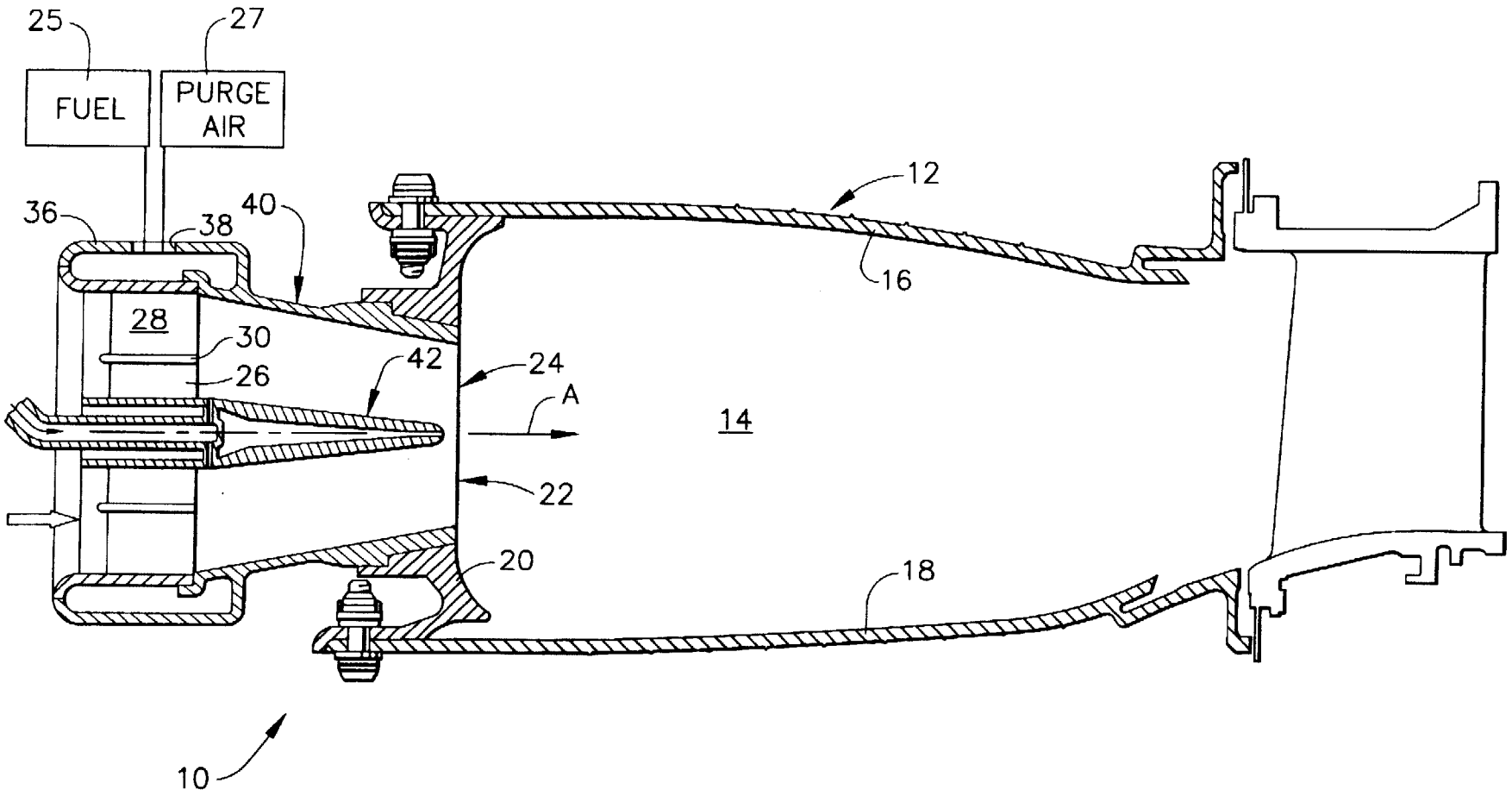
FIG. 1 is a partial cross sectional view through a single annular combustor structure including an air/fuel mixer in accordance with the present invention.

Referring now to the drawings in detail, wherein identical numerals indicate the same elements throughout the figures, FIG. 1 depicts a partial cross sectional view of a continuous burning combustion apparatus 10 of the type suitable for use in a gas turbine engine and comprises a hollow body 12 which defines a combustion chamber 14 therein. Hollow body 12 is generally annular in form and is comprised of an outer liner 16, an inner liner 18, and a domed end or dome 20. The domed end 20 of hollow body 12 includes a swirl cup 22, having disposed therein a mixer 24 to allow the uniform mixing of fuel and air therein and the subsequent introduction of the fuel/air mixture into combustion chamber 14 with the minimal formation of pollutants caused by the ignition thereof.

Figure 2:
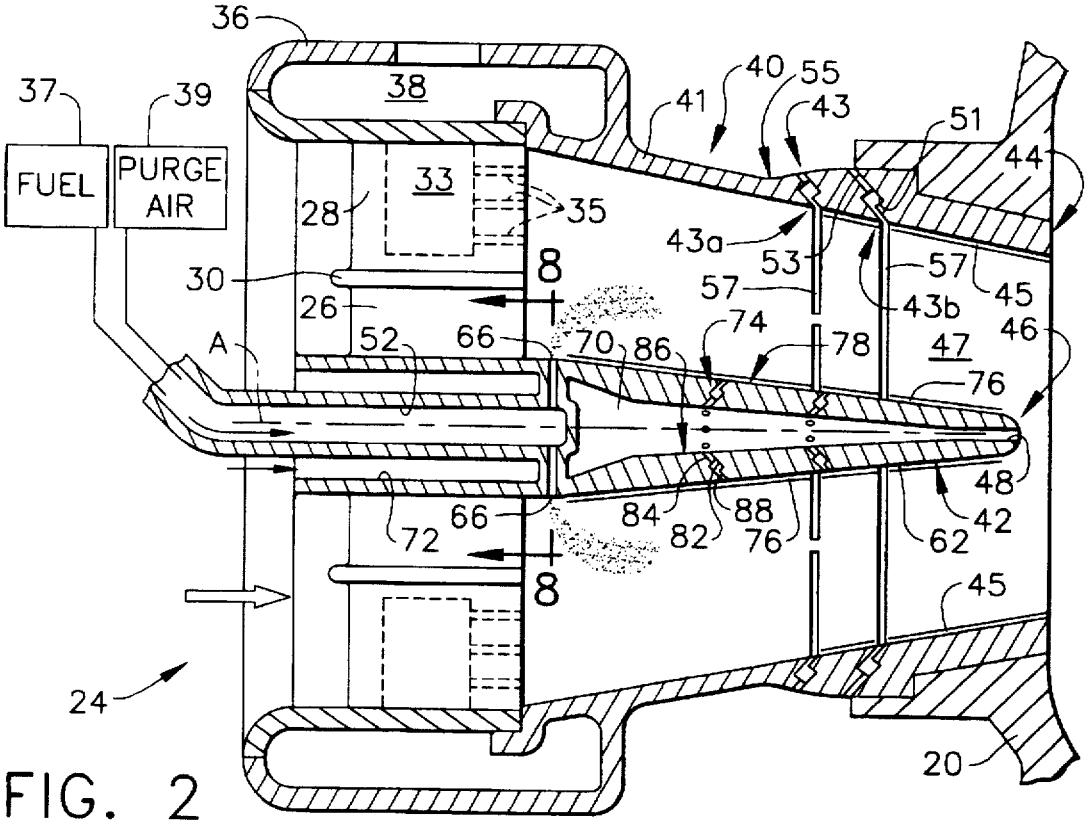
FIG. 2 is an enlarged, partial cross sectional view of the air/fuel mixer depicted in FIG. 1 including a plurality of air passages in the mixing duct and centerbody.
Figure 3:
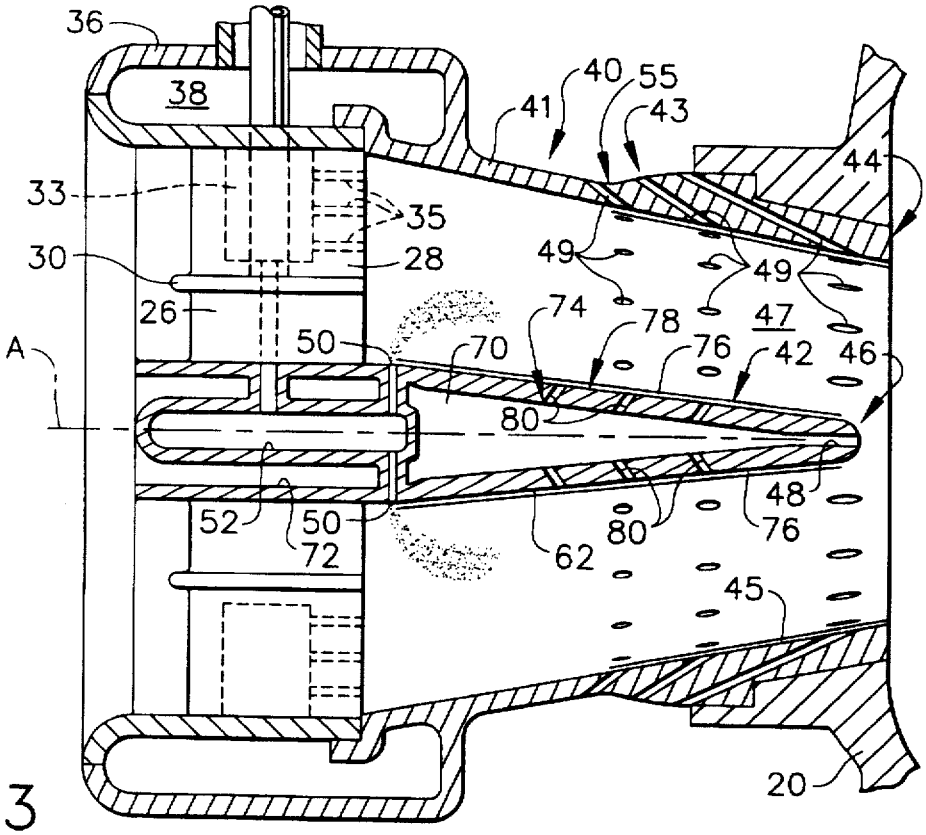
FIG. 3 is an enlarged, partial cross sectional view of an air fuel mixer like that in FIG. 2 with an alternative air passage configuration in the mixing duct and centerbody.

It will be understood that air fuel mixer 24, other than the modifications described herein, will generally take the form of the air fuel mixers in U.S. Pat. Nos. 5,351,477, 5,251,447 and 5,165,241 which are also owned by the assignee of the present invention and hereby incorporated by reference. Accordingly, mixer 24 includes an inner swirler 26 and an outer swirler 28 which are brazed or otherwise set in swirl cup 22, where inner and outer swirlers 26 and 28 preferably are counter-rotating. It is of no significance which direction air flowing through inner swirler 26 and outer swirler 28 rotates so long as it does so in opposite directions. Inner and outer swirlers 26 and 28 are separated by a hub 30, which allows them to be co-annular and separately rotate air entering such swirlers. As depicted in FIGS. 1–3, inner and outer swirlers 26 and 28 are preferably axial, but they may be radial or some combination of axial and radial. It will be noted that swirlers 26 and 28 have vanes (see items identified by numerals 32 and 34 in FIG. 3 of U.S. Pat. No. 5,251,447) at an angle in the 40°–60° range with an axis A running through the center of mixer 24. Also, the air mass ratio between inner swirler 26 and outer swirler 28 is preferably approximately ⅓.

A shroud 36 is provided which surrounds mixer 24 at the upstream end thereof with a fuel manifold 38 contained therein. Downstream of inner and outer swirlers 26 and 28 is an annular mixing duct 40 which has been modified in accordance with the present invention. Fuel manifold 38 is in flow communication with the vanes of outer swirler 28 and is metered by an appropriate fuel supply and control mechanism depicted schematically by box 25 in FIG. 1. Although not depicted in the figures, fuel passages could be provided so as to be in flow communication with the vanes of inner swirler 26. The vanes of outer swirler 28 are preferably of a hollow design, as shown and described in FIGS. **4*a* and 4*b* of U.S Pat. No. 5,251,447, with internal cavities 33 in flow communication with fuel manifold 38 and fuel passages 35 in flow communication with internal cavities 33. It will be seen in FIG. 1 that a purge air supply 27 is also associated with manifold 38 so that air may be supplied to purge manifold 38, internal cavities 33 and vane passages 35 when fuel is not injected therethrough. This purge air prevents hot air in combustion chamber 14 from recirculating into fuel passages 35**.

As seen in FIGS. 2 and 3, an annular wall 41 defining mixing duct 40 preferably has one or more air passages therethrough, identified generally by the numeral 43. Air passages 43 are in flow communication with compressed air from outside mixing duct 40 and permit such air to flow inside mixing duct 40, where it is utilized to energize a boundary layer 45 of air and fuel located along an inner annular surface 47 of wall 41. It will be seen in FIG. 3 that air passages 43 take the form of angled holes 49 through wall 41 which are preferably oriented at an angle in the range of 20°–30° with respect to inner annular surface 47 of wall 41 or at an angle in the range of 0°–20° with respect to the air exiting outer swirler 28.

Alternatively, as seen in FIG. 2, air passages 43 may be made up of a plenum 51 located within and circumscribing wall 41, a plurality of feed passages 53 extending from an outer annular surface 55 of wall 41 to plenum 51, and a slot 57 formed in wall 41 from inner annular surface 47 to plenum 51. In this way, air is communicated from outside outer annular surface 55 of mixing duct wall 41 to plenum 51 and thereafter from plenum 51 to inside mixing duct 40. It will be understood that FIG. 2 depicts only one feed passage 53 to plenum 51 for each air passage 43, but there preferably will be 5–20 of such feed passages 53. Further, slot 57 may be continuous completely about wall 41 (as depicted in a downstream air passage **43*b* in FIG. 2) or it may be segmented and discontinuous (as depicted in an upstream air passage 43*a* in FIG. 2). Slots 57, whether continuous or segmented, preferably will be oriented at an angle in the range of 20°–30° with respect to inner annular surface 47 of wall 41 or 0°–30° with respect to the air exiting outer swirler 28**.

It should be noted that air passages 43 described hereinabove with respect to mixing duct 40 may be implemented regardless of the manner in which fuel is injected into air/fuel mixer 24 or how the fuel and air is mixed therein. This is because the air supplied by such air passages 43 will be effective for energizing boundary layer 45 along inner annular surface 47 of wall 41 and increase the forward velocity of air in mixing duct 40. Moreover, the air will also have the effect of diluting the concentration of any fuel in boundary layer 45 and therefore the flame velocity therein, all of which will decrease the possibility of flashback within mixing duct 40.

A centerbody 42 is provided in mixer 24 which may be a straight cylindrical section or preferably one which converges substantially uniformly from its upstream end to its downstream end. Centerbody 42 is preferably cast within mixer 24 and is sized so as to terminate immediately prior to a downstream end 44 of mixing duct 40 in order to address a distress problem at centerbody tip 46, which occurs at high pressures due to flame stabilization at this location. Centerbody 42 preferably includes a passage 48 through centerbody tip 46 in order to admit air of a relatively high axial velocity into combustion chamber 14 adjacent centerbody tip 46. This design decreases the local fuel/air ratio to help push the flame downstream of centerbody tip 46.

Figure 5:
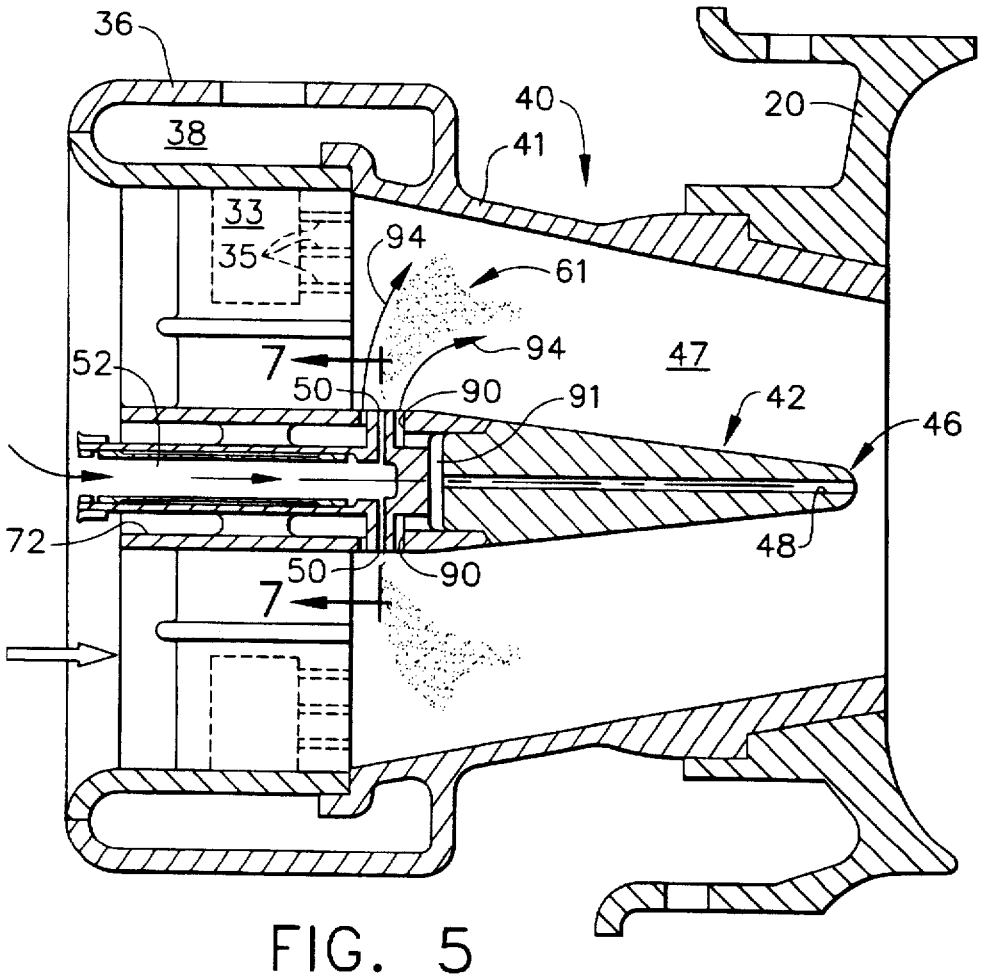
FIG. 5 is an enlarged, partial cross sectional view of an air/fuel mixer having air assist passages surrounding each centerbody fuel orifice.

Centerbody 42 further includes a plurality of orifices 50 positioned preferably immediately downstream of inner swirler 26 from which fuel also can be injected into mixing duct 40, as shown in FIGS. 3 and 5. Centerbody fuel orifices 50 are spaced circumferentially about centerbody 42 and while the number and size of such orifices 50 is dependent on the amount of fuel supplied thereto, the pressure of the fuel, and the number and particular design of swirlers 26 and 28, it has been found that 6 to 12 orifices work adequately. Fuel is supplied to centerbody orifices 50 by means of a fuel passage 52 within an upstream portion of centerbody 42. Fuel passage 52 is then in turn in flow communication with a fuel supply and control mechanism 37, such as by means of a fuel nozzle entering the upstream portion of centerbody 42 (as seen in FIG. 2) or a fuel line in flow communication with a separate fuel manifold in shroud 36 (as seen in FIG. 3). It will be understood that if gaseous and liquid fuel are to be injected within mixer 24, the gas fuel will preferably be injected through swirler vane passages 35 and the liquid fuel will be injected through centerbody fuel orifices 50. Further, fuel passage 52 is also associated with a purge air supply 39 so that air may be used to purge fuel from fuel passage 52 and orifices 50 when fuel is not injected into mixing duct 40 therethrough. Accordingly, it will be understood that the change of fuel types may be accomplished "on the fly" by ramping the amount of fuel injected through passages 35 or centerbody orifices 50 up while correspondingly ramping down the fuel injected by the other.

Figure 7:
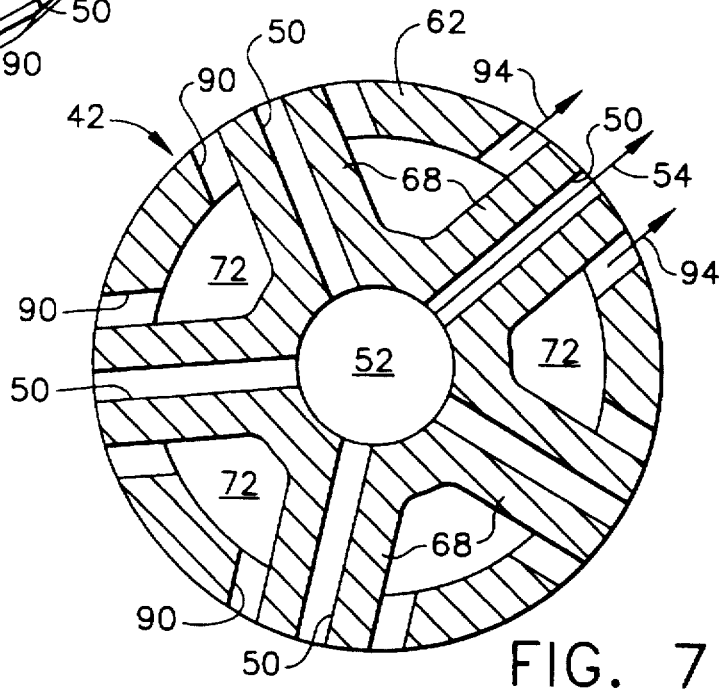
FIG. 7 is a partial end view of the centerbody depicted in FIG. 5 taken along lines 7—7.
Figure 8:
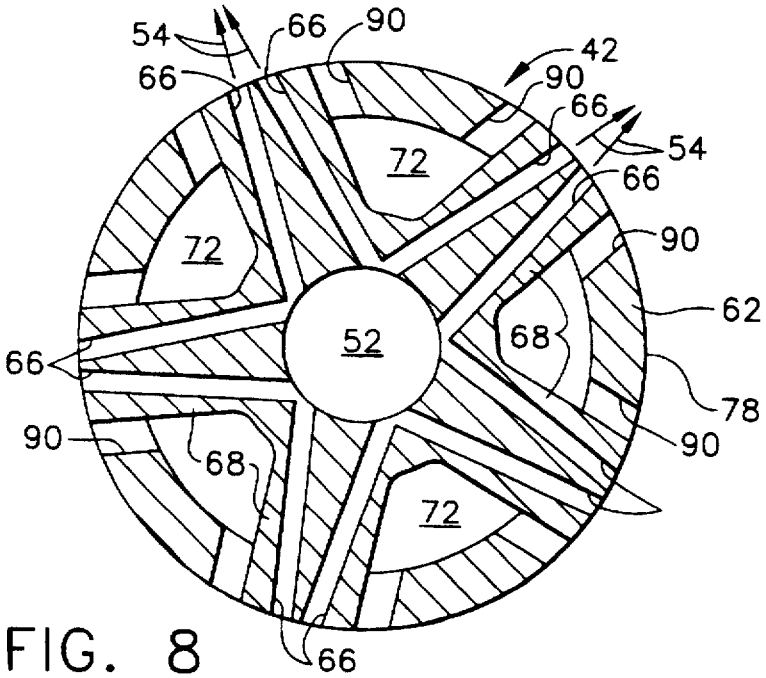
FIG. 8 is a partial end view of the centerbody in FIG. 2 taken along lines 8—8, including air assist passages as depicted in FIGS. 5–7.
Figure 9:
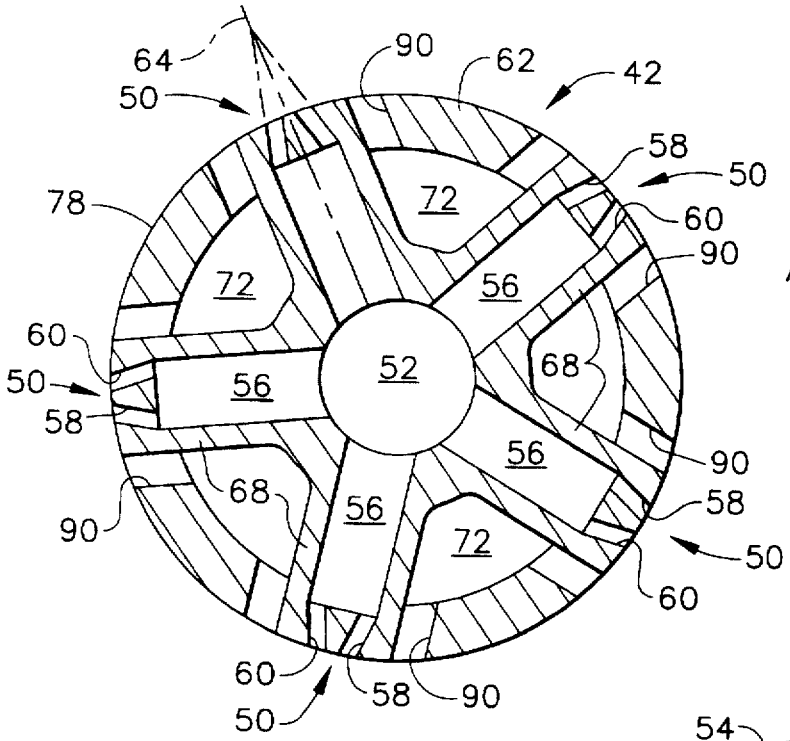
FIG. 9 is a partial end view of the centerbody of FIG. 8 having an alternative configuration for the fuel orifices therein, including air assist passages as depicted in FIGS. 5–7.
Figure 11:
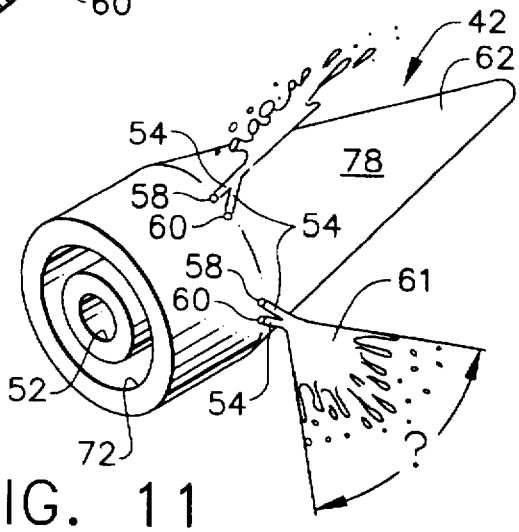
FIG. 11 is a partial schematic perspective view of the centerbody depicted in FIGS. 2 and 10 depicting a fan spray formed by the impingement of fuel jets injected from adjacent fuel orifices.

Preferably, each centerbody orifice 50 is oriented substantially radially outward. Adjacent fuel jets, identified by the numeral 54 in FIGS. 7, 8 and 11, impinge on each other as they are injected through adjacent centerbody orifices 50 to form a fan spray 61 in mixing duct 40 having an arcuate length corresponding to an angle between such adjacent orifices. This impingement of fuel jets 54, which generally will be comprised of liquid fuel, enhances atomization of the fuel within mixing duct 40 and promotes mixing with the air therein. As seen in FIG. 9, orifices 50 may involve a duct 56 in each of a plurality of radial spokes 68 contained in centerbody 42, with each duct 56 receiving fuel from fuel passage 52. A pair of angled openings 58 and 60 are then provided in centerbody wall 62 which are in flow communication with duct 56. With dashed line 64 acting as a centerline reference through duct 56, it will be seen that openings 58 and 60 will preferably be angled approximately +5° to −5° with respect thereto. Alternatively, each orifice 50 may be a separate angled passage 66 formed in spokes 68 which are in direct flow communication with fuel passage 52, as seen in FIG. 8.

Figure 10:
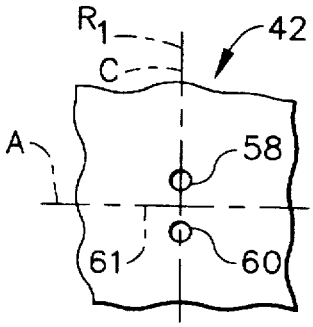
FIG. 10 is a partial schematic side view of the centerbody in FIG. 2 indicating that the centerbody fuel orifices lie in the same radial plane.
Figure 12:
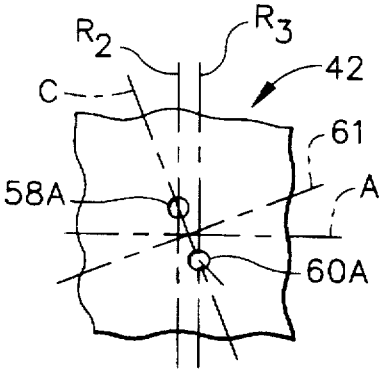
FIG. 12 is a partial schematic side view of the centerbody in FIG. 2 depicting the fuel orifices thereof lying in separate radial planes.
Figure 13:
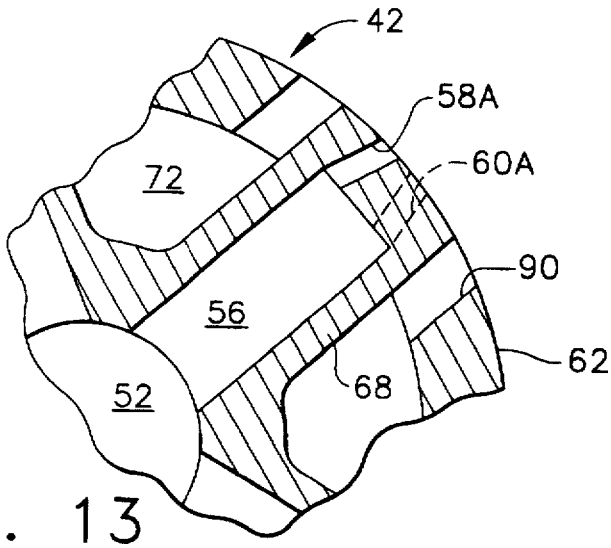
FIG. 13 is a partial end view of the centerbody depicted in FIG. 12.

It will be understood that fan spray 61 will be substantially planar and is formed substantially perpendicular to a centerline C (see FIGS. 10 and 12) through the middle of openings 58 and 60. In this way, fan spray 61 may be caused to have any number of orientations within mixing duct 40 (e.g., substantially perpendicular to the air exiting swirlers 26 and 28, substantially parallel to such air, or at any desired angle thereto). The desired orientation of fan spray 61 is then caused by the circumferential angle and axial placement of openings 58 and 60 or adjacent angled passages 66. In this regard, openings 58 and 60 may lie in the same radial plane $R_1$, as depicted in FIGS. 9 and 10, for fan spray 61 to be substantially perpendicular to air flow in mixing duct 40. Alternatively, openings **58*a* and 60*a* may lie in distinct radial planes $R_2$ and $R_3$, as depicted in FIGS. 12 and 13, to orient fan spray 61 at a desired angle to air flow in mixing duct 40**.

With respect to fuel orifices 50 of centerbody 42 being angled or oriented to cause impingement of fuel jets 54 injected therefrom, it will be understood that such configuration can be utilized whether mixer 24 offers fuel injection from a second source (e.g., fuel passages 35 in vanes 34) or not. This is because impinging such fuel jets together enhances atomization of the fuel in mixing duct 40, which has a positive effect in creating uniform mixture of fuel and air therein. In fact, such orienting of adjacent fuel passages may be implemented when fuel is injected through hub 30, as disclosed in U.S. Pat. No. 5,351,477, in order to enhance atomization of the liquid fuel injected therefrom substantially parallel to the air flow in the mixing duct.

Figure 14:
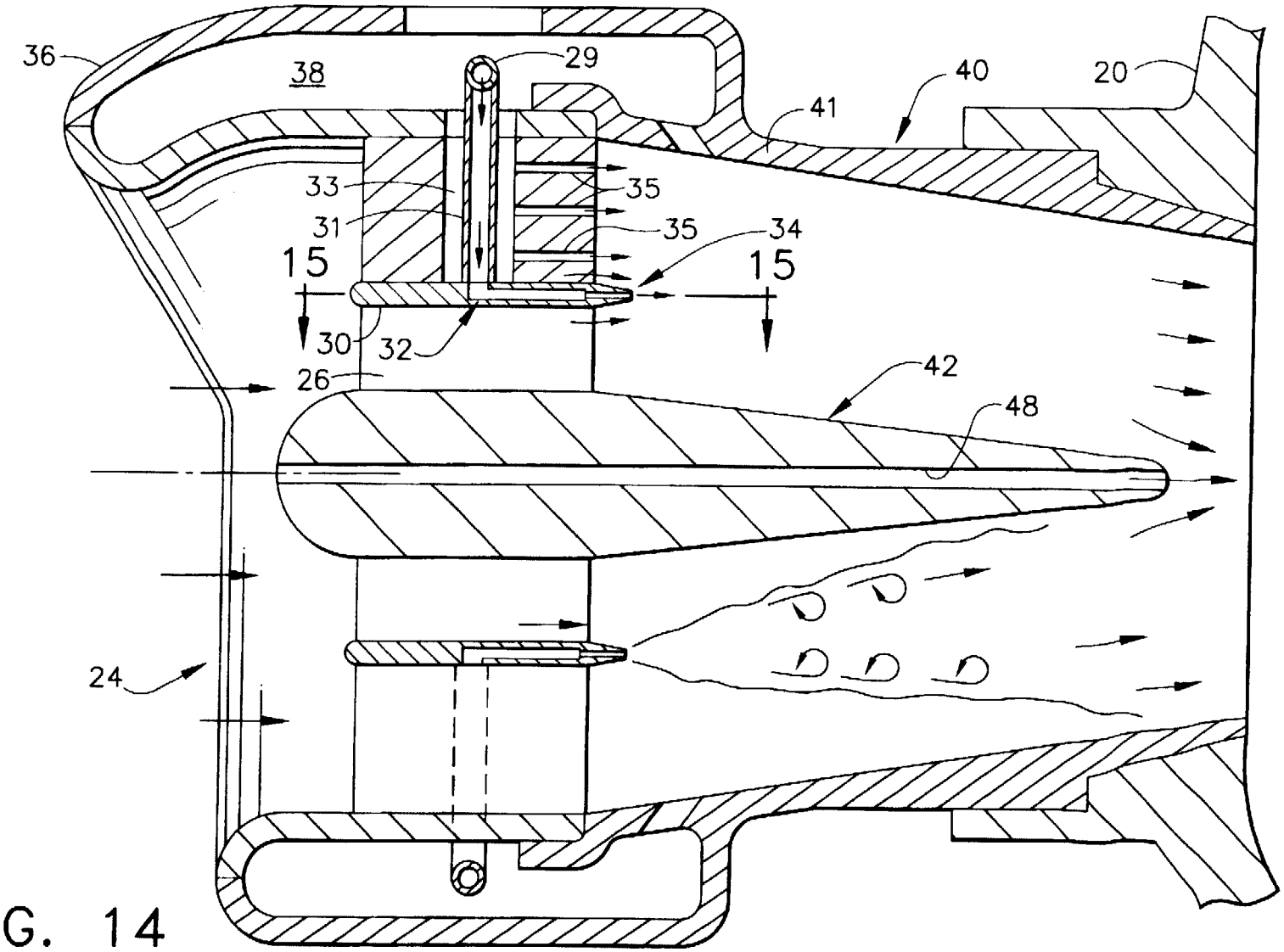
FIG. 14 is an enlarged, partial cross sectional view of an alternative air/fuel mixer design generally in accordance with U.S. Pat. No. 5,351,477.

More specifically, FIG. 14 depicts the fuel delivery arrangement of U.S. 5,351,477 where gas fuel flows from gas fuel manifold 38 into internal cavity 33 of the outer swirler vanes and through fuel passages 35. Liquid fuel flows from a liquid fuel manifold 29 located within gas fuel manifold 38 into a liquid fuel passage 31 provided in internal cavity 33. Thereafter, the liquid fuel flows into a circumferential slot 32 within hub 30 and out the downstream end thereof into combustion chamber 14.

Figure 15:
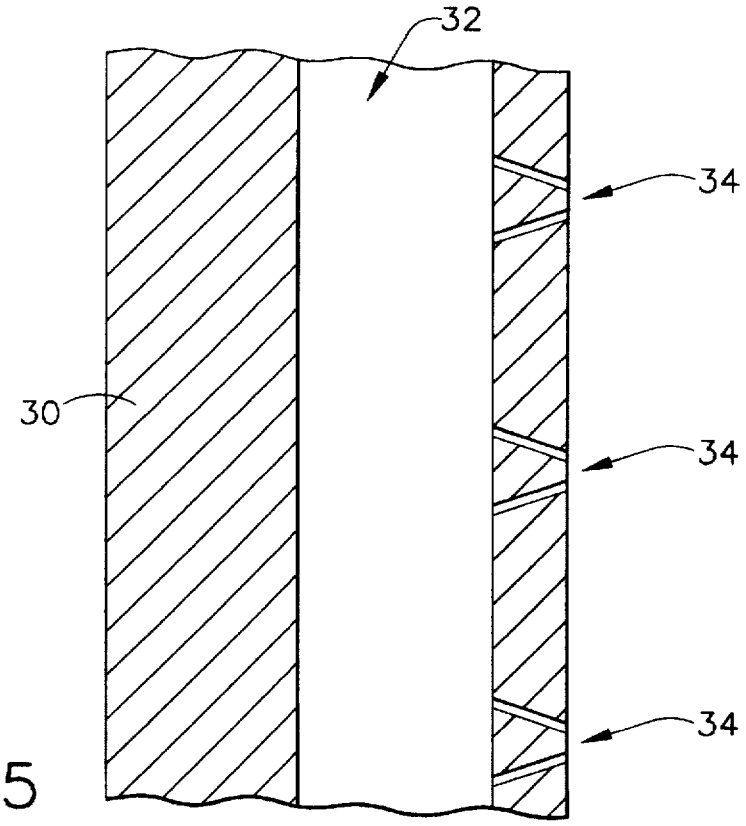
FIG. 15 is a partial radial view of the air/fuel mixer depicted in FIG. 14 taken along line 15—15.
Figure 16:
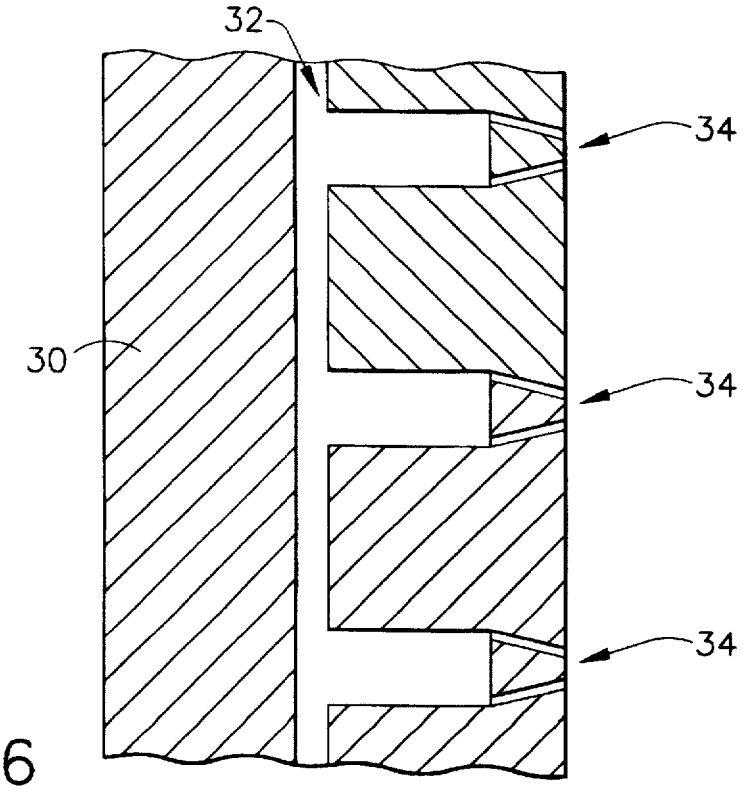
FIG. 16 is a partial radial view of an alternative configuration for the air/fuel mixer depicted in FIG. 14 as seen along line 15—15.

As seen in FIGS. 15 and 16, it is preferred that circumferential slot 32 have a plurality of angled hole pairs 34 at the downstream end of hub 30. In this way, fuel jets flowing through angled hole pairs 34 impinge upon each other enhancing atomization of the fuel as described with respect to the centerbody fuel orifices 50 above. It will be noted that circumferential slot 32 may be uniform around hub 30 as shown in FIG. 15 or have a plurality of circumferentially spaced segments aligned with the upstream ends of angled hole pairs 34 as shown in FIG. 16.

Figure 4:
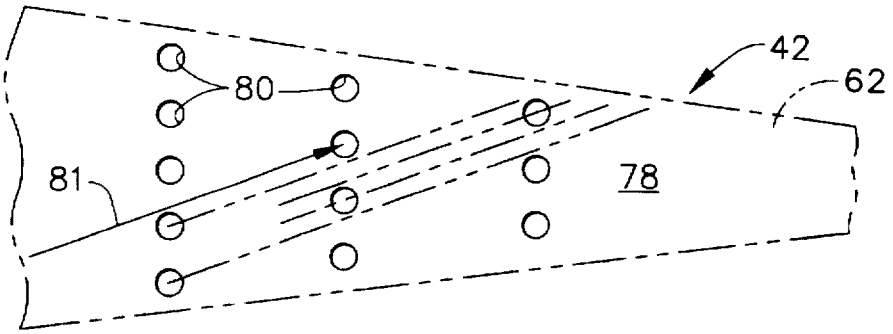
FIG. 4 is a partial fold out view of the centerbody depicted in FIG. 3.

As seen in FIGS. 2 and 3, centerbody 42 may be defined by an annular wall 62 and include a hollow area 70 from an upstream end adjacent orifices 50 to tip 46. Hollow area 70 is in flow communication with a main air passage 72 extending through an upstream portion of centerbody 42, with main air passage 72 preferably being concentric with and surrounding main fuel passage 52. Accordingly, air passages 74 are formed in centerbody wall 62 so that air flowing into hollow area 70 exits therefrom to energize a boundary layer 76 of fuel and air along an outer annular surface 78 of wall 62. As described with respect to air passages 43 in mixing duct wall 41, air passages 74 may take the form of angled holes 80 (see FIG. 3). Preferably, angled holes 80 will be oriented at an angle in the range of 20°–30° with respect to outer annular surface 78 of centerbody wall 62 or at an angle in the range of 0°–20° with respect to the air exiting inner swirler 26. In either event, it is preferred that such angled holes 80 be staggered, as shown in FIG. 4, with respect to other angled holes downstream therefrom in order to obtain maximum effect on boundary layer 76. In particular, angled holes 80 may be staggered according to the direction of air exiting inner swirler 26 as indicated by arrow 81.

Alternatively, as seen in FIG. 2, each air passage 74 may be made up of a plenum 82 located within and circumscribing centerbody wall 62, a plurality of feed passages 84 extending from an inner annular surface 86 defining hollow area 70 to plenum 82, and a slot 88 formed in centerbody wall 68 from outer annular surface 78 to plenum 82. In this way, air is communicated from hollow area 70 to plenum 82 and thereafter into mixing duct 40. It will be understood that FIG. 2 depicts only one feed passage 84 to plenum 82 for each air passage 74, but there preferably will be 5–20 of such feed passages 84. Further, slot 88 may be continuous completely around centerbody wall 62 or it may be segmented and discontinuous as shown in FIG. 2 with respect to slot 57 in mixing duct wall 41. In either event, slot 88 will preferably be oriented at an angle in the range of 20°–30° with respect to outer annular surface 78 of centerbody wall 62 or 0°–30° with respect to air exiting inner swirler 26.

As discussed hereinabove with respect to air passages 43 in mixing duct 40, air passages 74 may be implemented regardless of the manner in which fuel is injected into air/fuel mixer 24 or how the fuel and air is mixed therein. This is because the air supplied by such air passages 74 likewise will be effective for energizing boundary layer 76 along outer annular surface 78 of centerbody wall 62 and increase the forward velocity of air in mixing duct 40. Moreover, the air will also have the effect of diluting the concentration of any fuel in boundary layer 76 and therefore the flame velocity therein, all of which will decrease the possibility of flashback within mixing duct 40.

Figure 6:
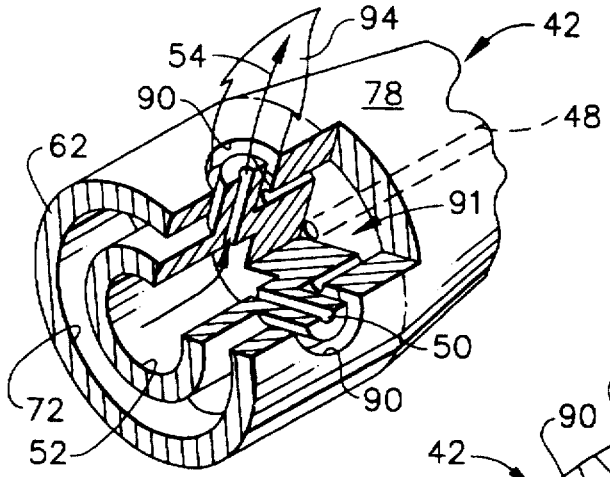
FIG. 6 is a partial perspective view of the centerbody depicted in FIG. 5 having a portion thereof cut away for clarity.

Centerbody 42 may also be constructed so as to have an air assist passage 90 associated with each fuel orifice 50. As seen in FIGS. 5–7, a plurality of radial spokes 68 are provided in centerbody 42 with fuel orifices 50 like those described hereinabove. Air assist passages 90 are preferably annular in configuration and surround fuel orifices 50 so that the air encircles the fuel jets 54 injected into mixing duct 40. This air, identified by the number 94, serves to direct the fuel away from outer annular surface 78 of centerbody wall 62 toward the main flow of air in mixing duct 40. Consequently, the assisting air from an air assist passage 90 helps to mninimize the formation of boundary layer 76 along centerbody wall 62, as well as promotes atomization of the fuel. It will be seen that air assist passages 90 are in flow communication with main air passage 72 and may be utilized with air passages 74 in centerbody wall 62 described herein by incorporating an air manifold 91 therebetween. Further, air assist passages 90 may be utilized with angled ducts 66 in radial spokes 68 (as shown in FIG. 8) or with fuel ducts 56 (as shown in FIG. 9).

It will be noted that air assist passages 90 may be implemented with or without hollow area 70 and air passages 74 in centerbody 42 (see FIGS. 2 and 3) or air passage 48 (see FIG. 5). This is because air 94 supplied by such air assist passages 90 will be effective for enhancing atomization of the fuel jets 54 injected into mixing duct 40. Moreover, such air helps to diminish the boundary layer 76 which forms along outer annular surface 78 of centerbody 42, as well as the fuel concentration in such boundary layer, thereby decreasing the possibility of flashback within mixing duct 40.

Inner and outer swirlers 26 and 28 are designed to pass a specified amount of air flow and fuel manifold 36 is sized to permit a specified amount of fuel flow so as to result in a lean premixture at an exit plane of mixer 24. By "lean" it is meant that the fuel/air mixture contains more air than is required to fully combust the fuel, or an equivalence ratio of less than one. It has been found that an equivalence ratio in the range of 0.4 to 0.7 is preferred.

As shown in FIG. 2 of U.S. Pat. No. 5,251,447, the air flow (identified by the numeral 60 in the '447 patent) exiting inner swirler 26 and outer swirler 28 sets up an intense shear layer (identified by the numeral 45 in the '447 patent) in mixing duct 40. The shear layer is tailored to enhance the mixing process, whereby fuel flowing through the outer swirler vanes is uniformly mixed with the intense shear layer, as well as to prevent backflow along wall 41 of mixing duct 40. Mixing duct 40 may be a straight cylindrical section, but preferably should be uniformly converging from its upstream end to its downstream end so as to increase flow velocities and prevent backflow from the primary combustion region. Additionally, the converging design of mixing duct 40 acts to accelerate the fuel/air mixture flow uniformly, which helps to mninimize boundary layers from accumulating along the sides thereof and flashback stemming therefrom. (Inner and outer swirlers 26 and 28 may also be of a like converging design).

In operation, compressed air from a compressor (not shown) is injected into the upstream end of mixer 24 where it passes through inner and outer swirlers 26 and 28 and enters mixing duct 40. Fuel is injected into an air flow stream exiting swirlers 26 and 28 (which includes intense shear layers) from passages 35 in vanes 34 and/or fuel orifices 50 in centerbody 42. At the downstream end 44 of mixing duct 40, the premixed fuel/air flow is supplied into a mixing region of combustion chamber 14 which is bounded by inner and outer liners 18 and 16. The premixed fuel/air flow is then mixed with recirculating hot burnt gases and burned in combustion chamber 14.

Having shown and described the preferred embodiment of the present invention, further adaptations of the dual fuel mixer for providing uniform mixing of fuel and air and minimizing boundary layers along the mixing duct wall and the centerbody can be accomplished by appropriate modifications by one of ordinary skilled in the art without departing from the scope of the invention. Further, it will be understood that the air passages 43 in mixing duct wall 41, the air passages 74 in centerbody wall 62, the angled centerbody fuel orifices 50, and the air assist passages 90 may be incorporated singly or in any combination, whether with the dual fuel mixer 24 described herein or with any air/fuel mixer of a gas turbine engine having the requisite associated elements.

What is claimed is:

1. An apparatus for premixing fuel and air prior to combustion in a gas turbine engine, comprising:

(a) a linear mixing duct having a circular cross section defined by a wall, said mixing duct wall including a plurality of air passages therethrough, wherein air flowing through said air passages energizes a boundary layer along an inner annular surface of said mixing duct wall;

(b) means for injecting fuel into said mixing duct; and (c) means for mixing said fuel and air in said mixing duct.

2. The apparatus of claim 1, each of said air passages comprising an angled hole through said mixing duct wall.

3. The apparatus of claim 2, each of said air passages being oriented at an angle to said inner annular surface of said mixing duct wall within a range of 20°–30°.

4. The apparatus of claim 1, each of said air passages further comprising:

(a) a plenum located within and circumscribing said mixing duct wall;

(b) a plurality of feed passages extending from an outer annular surface of said mixing duct wall to said plenum, wherein air is communicated from outside said outer annular surface of said mixing duct to said plenum; and (c) a slot formed in said mixing duct wall from said inner annular surface to said plenum, wherein air is communicated from said plenum to inside said mixing duct.

5. The apparatus of claim 4, wherein said slot extends completely around said mixing duct.

6. The apparatus of claim 4, wherein said slot is segmented around said mixing duct.

7. The apparatus of claim 4, each of said slots being oriented at an angle to said inner annular surface of said mixing duct wall within a range of 20–30.

8. The apparatus of claim 1, further comprising a centerbody defined by a circular wall located in the middle of said mixing duct, said centerbody comprising:

(a) a hollow area from an upstream end to a downstream end;

(b) a main air passage in flow communication with said hollow area; and (c) a plurality of air passages in said centerbody wall in flow communication with said hollow area;

wherein air supplied to said hollow area by means of said main air passage flows through said centerbody wall air passages into said mixing duct to energize a boundary layer along an outer annular surface of said centerbody wall.

9. The apparatus of claim 8, each of said centerbody wall air passages comprising an angled hole through said centerbody wall.

10. The apparatus of claim 9, each of said centerbody wall air passages being oriented at an angle to said outer annular surface of said centerbody wall within a range of 20°–30°.

11. The apparatus of claim 8, each of said centerbody wall air passages further comprising:

(a) a plenum located within and circumscribing said centerbody wall;

(b) a plurality of feed passages extending from an inner annular surface of said centerbody wall to said plenum, wherein air is communicated from said centerbody hollow area to said plenum; and (c) a slot formed in said centerbody wall from said centerbody outer annular surface to said plenum, wherein air is communicated from said plenum to inside said mixing duct.

12. The apparatus of claim 11, wherein said slot extends completely around said centerbody.

13. The apparatus of claim 11, wherein said slot is segmented around said centerbody.

14. The apparatus of claim 11, each of said slots being oriented at an angle to said inner annular surface of said mixing duct wall within a range of 20–30.

15. The apparatus of claim 1, said fuel and air mixing means further comprising:

(a) a set of inner and outer annular counter-rotating swirlers adjacent the upstream end of said mixing duct for imparting swirl to an air stream; and (b) a hub separating said inner and outer annular swirlers to allow independent rotation of said air stream;

wherein high pressure air from a compressor is injected into said mixing duct through said swirlers to form an intense shear region and fuel is injected into said mixing duct so that the high pressure air and the fuel is uniformly mixed therein so as to produce minimal formation of pollutants when the fuel/air mixture is exhausted out the downstream end of said mixing duct into the combustor and ignited.

16. The apparatus of claim 15, each of said air passages being oriented at an angle to a swirled air stream in said mixing duct within a range of 0°–30°.

17. The apparatus of claim 8, said fuel and air mixing means further comprising:

(a) a set of inner and outer annular counter-rotating swirlers adjacent the upstream end of said mixing duct for imparting swirl to an air stream; and (b) a hub separating said inner and outer annular swirlers to allow independent rotation of said air stream;

wherein high pressure air from a compressor is injected into said mixing duct through said swirlers to form an intense shear region and fuel is injected into said mixing duct so that the high pressure air and the fuel is uniformly mixed therein so as to produce minimal formation of pollutants when the fuel/air mixture is exhausted out the downstream end of said mixing duct into the combustor and ignited.

18. The apparatus of claim 17, each of said centerbody air passages being oriented at an angle to a swirled air stream in said mixing duct within a range of 0°–30°.

19. The apparatus of claim 15, said fuel injection means further comprising:

(a) a shroud surrounding the upstream end of said mixing duct, said shroud having contained therein a fuel manifold in flow communication with a fuel supply and control means; and (b) said outer annular swirlers including hollow vanes with internal cavities, wherein the internal cavities of said outer swirler vanes are in flow communication with said fuel manifold, said outer swirler vanes further including a plurality of fuel passages therethrough in flow communication with said internal cavities to inject fuel into said mixing duct.

20. The apparatus of claim 15, said fuel injection means comprising a fuel nozzle located axially along and forming a centerbody substantially the full length of said mixing duct, said fuel nozzle having a plurality of orifices therein located immediately downstream of said inner and outer swirlers to inject fuel into said mixing duct.

21. An apparatus for premixing fuel and air prior to combustion in a gas turbine engine, comprising:

(a) a linear mixing duct having a circular cross section defined by a wall;

(b) a centerbody defined by a circular wall located in the middle of said mixing duct, said centerbody further comprising:

(1) a hollow area from an upstream end to a downstream end;

(2) a main air passage in flow communication with said hollow area; and (3) a plurality of air passages in said centerbody wall in flow communication with said hollow area;

wherein air supplied to said hollow area by means of said main air passage flows through said centerbody wall air passages into said mixing duct to energize a boundary layer along an outer annular surface of said centerbody wall;

(c) means for injecting fuel into said mixing duct; and (d) means for mixing said fuel and air in said mixing duct.

22. The apparatus of claim 21, each of said centerbody wall air passages comprising an angled hole through said centerbody wall.

23. The apparatus of claim 22, each of said centerbody wall air passages being oriented at an angle to said outer annular surface of said centerbody wall within a range of 20°–30°.

24. The apparatus of claim 21, each of said centerbody wall air passages further comprising:

(a) a plenum located within and circumscribing said centerbody wall;

(b) a plurality of feed passages extending from an inner annular surface of said centerbody wall to said plenum, wherein air is communicated from said centerbody hollow area to said plenum; and (c) a slot formed in said centerbody wall from said centerbody outer annular surface to said plenum, wherein air is communicated from said plenum to inside said mixing duct.

25. The apparatus of claim 24, wherein said slot extends completely around said centerbody.

26. The apparatus of claim 24, wherein said slot is segmented around said centerbody.

27. The apparatus of claim 24, each of said slots being oriented at an angle to said outer annular surface of said centerbody wall within a range of 20°–30°.

28. The apparatus of claim 21, said fuel and air mixing means further comprising:

(a) a set of inner and outer annular counter-rotating swirlers adjacent the upstream end of said mixing duct for imparting swirl to an air stream; and (b) a hub separating said inner and outer annular swirlers to allow independent rotation of said air stream;

wherein high pressure air from a compressor is injected into said mixing duct through said swirlers to form an intense shear region and fuel is injected into said mixing duct so that the high pressure air and the fuel is uniformly mixed therein so as to produce minimal formation of pollutants when the fuel/air mixture is exhausted out the downstream end of said mixing duct into the combustor and ignited.

29. The apparatus of claim 28, each of said centerbody air passages being oriented at an angle to a swirled air stream in said mixing duct within a range of 0°–30°.

30. The apparatus of claim 28, said fuel injection means further comprising:

(a) a shroud surrounding the upstream end of said mixing duct, said shroud having contained therein a fuel manifold in flow communication with a fuel supply and control means; and (b) said outer annular swirlers including hollow vanes with internal cavities, wherein the internal cavities of said outer swirler vanes are in flow communication with said fuel manifold, said outer swirler vanes further including a plurality of fuel passages therethrough in flow communication with said internal cavities to inject fuel into said mixing duct.

31. The apparatus of claim 28, said fuel injection means comprising a fuel nozzle located axially along and forming a centerbody substantially the full length of said mixing duct, said fuel nozzle having a plurality of orifices therein located immediately downstream of said inner and outer swirlers to inject fuel into said mixing duct.

32. The apparatus of claim 21, said centerbody further comprising:

(a) a plurality of orifices therein to inject fuel into said mixing duct; and (b) at least one air passage located adjacent each of said fuel orifices, said air passages being in flow communication with said main air passage, wherein air from said air passages directs fuel away from an outer annular surface of said centerbody and assists atomization of said fuel.

* * * * *